US008466841B1

(12) United States Patent
Kough et al.

(10) Patent No.: US 8,466,841 B1
(45) Date of Patent: Jun. 18, 2013

(54) DIPOLE ANTENNA WITH GAMMA MATCHING

(75) Inventors: Douglas Blake Kough, San Jose, CA (US); Joe Freeman Britt, Jr., Los Altos, CA (US)

(73) Assignee: Google Inc., Mountain View, CA (US)

( * ) Notice: Subject to any disclaimer, the term of this patent is extended or adjusted under 35 U.S.C. 154(b) by 0 days.

(21) Appl. No.: 13/541,859

(22) Filed: Jul. 5, 2012

(51) Int. Cl.
*H01Q 1/24* (2006.01)
*H01Q 9/26* (2006.01)

(52) U.S. Cl.
USPC ..... 343/702; 343/720; 343/795; 343/803

(58) Field of Classification Search
USPC ..... 343/702, 720, 795, 802, 803, 820, 343/821
See application file for complete search history.

(56) References Cited

U.S. PATENT DOCUMENTS

| | | | | |
|---|---|---|---|---|
| 5,818,385 | A | 10/1998 | Bartholomew | |
| 7,053,836 | B2 * | 5/2006 | Huang | 343/700 MS |
| 7,274,117 | B1 * | 9/2007 | Viola et al. | 307/112 |
| 8,249,532 | B2 * | 8/2012 | Nysen et al. | 455/129 |
| 2009/0228608 | A1 | 9/2009 | Nysen et al. | |

FOREIGN PATENT DOCUMENTS

EP 1401111 B1 3/2011

OTHER PUBLICATIONS

'Antenna Projects information: Gamma Match Equations and associated Confusion' [online] [Retrieved on Feb. 6, 2012]; Bills Stuff Minimalist Wireless Webpage, Retrieved from the internet: < URL:http://n6mw.ehpes.com/>; 2 pages (table of contents and article).

"VHF Dipole with "Gamma" match system" [online] [retrieved on Jul. 5, 2012; available on Feb. 6, 2012] Retrieved from SV1BSX'x Homebrew Corner [URL: http://www.qsl.net/sv1bsx/homebrew.html] using the internet: < URL: http://www.gsl.net/sv1bsx/gammadip/gammadip.html> ; 2 pages. (Home page and article page).

* cited by examiner

*Primary Examiner* — Michael C Wimer
(74) *Attorney, Agent, or Firm* — Morris & Kamlay LLP

(57) ABSTRACT

Disclosed are a system and a device including a dipole antenna, signal conductors and a transceiver. The dipole antenna may be enclosed in a housing, and have offset signal connections for transmitting and receiving signals. The signal conductors may be communicatively connected to the offset signal connections. The transceiver may be connected to the signal conductors through a balanced communication signal path. The impedance of the dipole antenna may be substantially gamma matched to the impedance of the balanced communication signal path and an input impedance of the transceiver according to an amount of offset of the signal connections.

26 Claims, 4 Drawing Sheets

DIPOLE ANTENNA WITH GAMMA MATCHING

BACKGROUND

Antennas are often used for radiating a signal into free space for receipt by another device. Different antennas radiate signals differently. However, all antennas require that the radiated signal make a complete circuit with the signal source. For example, a portion of the signal radiating from an antenna formed by a single wire, i.e., a monopole antenna, will electrically couple with the electrical ground surrounding the antenna. The electrical ground is referred to as the "ground plane." Certain antenna types, such as inverted "F" or bent monopoles are susceptible to interference by other concurrent signal currents such as digital circuits, clocks and other fast switching signals. Often, shared return paths for the antenna currents and high speed digital signals interfere with one another. The use of different antenna configurations as well as shielding techniques can minimize the effects of the ground plane interference.

One antenna configuration that may reduce ground plane interference is a dipole antenna. A dipole antenna includes a feeder conductor and a resonant conductor (also called an antenna conductor). Typically, the resonant conductor has an overall length that is approximately equal to a half wavelength. The feeder conductor provides signals to the resonant conductor. The resonant conductor may be envisioned as two conductors shorted together at the center. A parallel arm conductor may be connected to the resonant conductor to establish a desired resonance. The resonant conductor length is typically an odd number of half wavelengths long, which is shorter in length than the parallel arm conductor. The parallel arm conductor may couple parasitically to the feeder conductor, and re-radiate a signal if properly stagger-tuned to the resonant conductor. The resonant conductor is supplied by a signal source at a pair of feed points from the feeder conductor near its center, and the resonant conductor may connect to the feeder conductor near to one of feed points.

The signal source provides a signal having a current and a voltage. The length, diameter and volume of the antenna conductors affect the impedance and bandwidth of the antenna. At the center of the feeder conductor, the current value is at a maximum and the voltage value is at a minimum. This results in a low impedance at the center of the feeder conductor. By matching the impedance of the antenna, called "gamma matching," to the input impedance of the signal source, the optimum power transfer between the feeder and the signal source and the maximum operational efficiency may be attained for signal transmission and reception. The dimensions (conductor length and diameter (i.e. volume)) of the resonant conductor and the resonant conductor's placement on the feeder conductor are selected by gamma matching. Typically, most systems use a balun to provide a balanced current that is out of phase.

BRIEF SUMMARY

According to an implementation of the disclosed subject matter, a device including a dipole antenna, signal conductor and a transceiver may be provided. The dipole antenna may be enclosed in housing, and have offset signal connections for transmitting and receiving signals. The signal conductors may be connected to the offset signal connections. The transceiver may be connected to the signal conductors through a balanced communication signal path. The impedance of the dipole antenna may be substantially gamma matched to the impedance of the balanced communication signal path and an input impedance of the transceiver according to an amount of offset of the signal connections.

The device may be enclosed in a switch plate housing or a housing of a household appliance. The signal chain impedance may include an impedance of the signal conductors and an impedance of the transceiver. The feed points of the two dipole antenna conductors may be offset to produce an impedance of the dipole antenna conductors that substantially matches the impedance of the connectors and the transceiver. The balanced communication signal path may provide substantially equal current to both feed points of the dipole antenna conductors.

The feed points of the two dipole antenna conductors may be offset to produce an impedance of the dipole antenna that substantially matches the impedance of the connectors and the transceiver. The signal path communication line between the transceiver and the signal conducting pins may be balanced. The transceiver may be implemented on a printed circuit board. The printed circuit board may include a balanced signal path communication line. The balanced signal path communication line may include a pair of signal lines that have substantially equal impedance.

Also disclosed is an implementation of a system that may include a housing, a dipole antenna, a transceiver and connectors. The housing may be an electrical switch plate, such as a wall switch plate, or may be incorporated into an appliance. The dipole antenna may have two conductors, each having a respective signal feed point. The two conductors of the antenna may be shaped to conform to the housing and include signal feeds. The transceiver may couple to a pair of signal connections for connecting the transceiver to the signal feeds of the respective conductors. The signal path between the transceiver and the two conductors may be balanced such that a current value on each of the pair of signal connection is substantially the same.

The signal feeds to the two conductors may be offset from one another to produce an impedance of the dipole antenna that substantially matches the impedance of the connectors and the transceiver. The connectors may be spring tight connectors, spring clip connectors, or the like.

The housing may be, for example, an electrical switch plate, a receptacle cover, or be contained within a household appliance, such as a television or microwave. The housing may be formed from a conductive material that may provide the same functionality as the dipole antenna.

Additional features, advantages, and implementations of the disclosed subject matter may be set forth or apparent from consideration of the following detailed description, drawings, and claims. Moreover, it is to be understood that both the foregoing summary and the following detailed description are exemplary and are intended to provide further explanation without limiting the scope of the claims.

BRIEF DESCRIPTION OF THE DRAWINGS

The accompanying drawings, which are included to provide a further understanding of the disclosed subject matter, are incorporated in and constitute a part of this specification. The drawings also illustrate implementations of the disclosed subject matter and together with the detailed description serve to explain the principles of implementations of the disclosed subject matter. No attempt is made to show structural details in more detail than may be necessary for a fundamental understanding of the disclosed subject matter and various ways in which it may be practiced.

DETAILED DESCRIPTION

There is a need for a balanced dipole antenna implementation that provides increased bandwidth and reduced self-interference properties within an appliance. By taking advantage of the properties of a dipole antenna, a system of networked devices may be implemented in a business or residence. In the presently described implementations, a dipole antenna may have a shape and configuration that may allow it to properly operate at the frequencies suitable for effective communication between networked devices and/or a controller in a system configuration.

Figure 1:
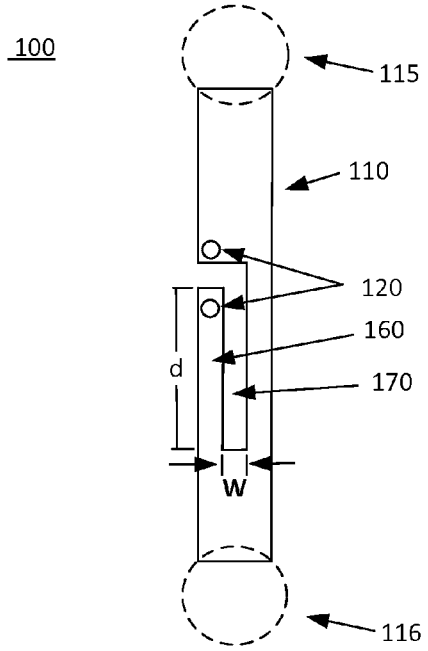
FIG. 1 shows an exemplary dipole antenna implementation according to an implementation of the disclosed subject matter.

In order to provide effective communications, an antenna that provides efficient communication and optimum power transfer may be selected to provide an appropriate frequency response for the system. FIG. 1 illustrates an exemplary dipole antenna according to an implementation of the disclosed subject matter. The dipole antenna 100 may include a conductor 110 and feed points 120. The conductor 110 may include an offset conductor 160 that moves the typical center feed of typical dipole antenna. The feed points 120 may be for receiving signals for processing by a signal processing device, and transmitting signals from a signal source, such as a transceiver.

In a simplistic description, the impedance at the feed points 120 of the antenna 100 may be approximately determined according to Ohm's law (i.e. V=IR, where V=voltage, I=current, and R=resistance or impedance). The signal provided by the signal source may be a sinusoidal signal in which the current is out of phase with the voltage. At the feed points 120 of the dipole antenna 100, the current I is a maximum and the voltage V is a minimum. As a result, the impedance R at the feed point 120 may be considered similar to that of a short circuit, in which V(Min)/I (Max)=R(Min). Conversely, at the ends of the antenna conductor 110, current is a minimum and voltage is a maximum. In this case, the impedance at the end points of the conductor 110 may be considered to be similar to that of an open circuit, in which V(Max)/I (Min)=R(Max). Therefore, it may be possible to tune the impedance by manipulating the current and voltage distribution along the conductor 110 by altering one or both of the feed points 120. For example, in the illustrated example, one of the feed points 120 may be located substantially at the end of the offset conductor 160, which may effectively move the feed point 120 from the center of the conductors 110. As a result, the signal connects, or feed points may be physically offset from one another.

As shown in the example configuration, a first of the feed points 120 may be near the end of the offset conductor 160 and a second of the feed points 120 may remain near the center of the conductor 110. The offset conductor 160 may be formed by a slot 170 that separates the offset conductor 160 from the conductor 110. The offset conductor 160 may have a length d, and the slot 170 may have a width w. The combination of the offset conductor 160 length d and the slot 170 width w may effectively put the feed point on the offset conductor 160 further away from the center of the conductor 110. As a result, the antenna 100 impedance may be tuned, for example, to substantially 50 ohms, so that the current and voltage distribution along the resonant conductor results in the resonant conductor. By effectively moving the feed point a certain distance from the center of the conductor 110, gamma matching is performed. Of course, other impedance values may be obtained, such as 75 ohms, by altering the length d of the offset conductor 160, the width w of the slot 170, or both (for a given thickness and material composition of conductor 110). The impedance of the dipole antenna 100 may be substantially gamma matched to a signal chain impedance according to an amount of offset of the feed points 120, or signal connections.

In addition, the effective bandwidth may also be manipulated by the volume of the conductor 110. When the antenna conductors 110 have less volume, the antenna has less bandwidth, and when the conductor 110 volume is greater, the antenna 100 has a higher bandwidth. Accordingly, the antenna volume may be appropriately scaled to accommodate different frequency ranges, such as Wi-Fi, for example. Additional methods of increasing bandwidth to accommodate variations in manufacturing of components in the networked devices, for example, and/or further tuning the antenna 100 to the desired frequency are also contemplated. For example, the bandwidth of antenna 110 may be increased by adding tuning elements 115 and 116 at the ends of the conductor 110. The elements 115 and 116 may increase the conductor 110 volume. The increased volume may alter the current distribution of the conductor 110. As a result, the current at the feed point 120 may be at a particular value that results in an appropriate antenna impedance and bandwidth for the respective application. The antenna 110 may have dimensions including a volume that are suitable for the frequency being used by the network system. For example, an antenna used in a 900 MHz environment may have different dimensions, including volume, than one used in a Wi-Fi environment.

Another tuning technique that may be used is delta matching. Delta matching may utilize multiple offset conductors having respective lengths and volumes that in combination provide the desired tuning.

An example system configuration of a disclosed implementation will be described with respect to FIG. 2. The system 200 may include a dipole antenna 210, offset feed points 220, feed lines 225, a transceiver 230, a printed circuit board (PCB) 240 and a housing 250. A processor 243 may be coupled to the PCB 240. In an example system implementation, a dipole antenna 210 may be configured to be coupled to, or incorporated into, a wall switch plate or similar housing 250, and to transmit and receive signals usable by a transceiver. The conductors of the dipole antenna 210 may be formed from conductor wires, or other conductors. The PCB 240 may include additional electronic components and circuitry. The circuitry in combination with the processor 243 may function as a control unit of connected devices, such as light bulbs in the case of a switch implementation, or of an appliance, if the system 200 is implemented with a receptacle. Alternatively, the system 200 may act as a gateway and pass data between connected devices and a network (not shown).

The dipole antenna 210 may be formed from two conductors having feed points offset from one another that provide an appropriate impedance matching, or gamma matching. The two conductors may be coupled together by a conductive member. Alternatively, the dipole antenna 210 may be a single antenna conductor having two effective conducting regions fed at respective feed points by balanced signal communication lines 225 via offset feed points 220. A first of the offset feed points 220 may be located on an offset conductor, and a second of the offset feed points 220 may be located near the center of the dipole antenna 210. As a result, the first of the offset feed points 220 may be physically offset from a second of the offset feed points 220.

The transceiver 230 may be arranged near the edge of the PCB 240 closest to the antenna 210 in order to mitigate the chances of any radiated signals interfering with the circuitry on the PCB 240, such as the processor 143. The PCB 240 may act as the ground plane of the system 200. The transceiver 230 may couple to a pair of balanced signal path communication lines 225 that may connect the transceiver 230 to the offset feed points 220 of the respective conductors. The transceiver 230 may be implemented on the printed circuit board 240. The printed circuit board 240 may include the balanced signal path communication lines 225. The balanced signal path communication lines 225 may have a pair of signal lines that have substantially equal impedance through which currents of equal value may pass between the transceiver 230 and the offset feed points 220. The balanced signal path communication lines 225 between the transceiver 230 and the offset feed points 220 may be a balanced signal path, such that a current value on each of the pair of signal connection is substantially the same. The balanced signal path communication lines 225 may be balanced without the use of a balun. The dipole antenna 210 may be tuned to operate at a frequency range suitable for the transceiver 230. For example, the transceiver 230 may operate at a frequency of approximately 900 MHz. Alternatively, the transceiver 230 may operate within an ISM band of frequencies (e.g., 915 MHz, 2.45 GHz or 5.8 GHz), Wi-Fi frequencies, or the like. However, the dipole antenna 210 may be configured to operate within a certain frequency range (e.g., approximately 10-15% around a center frequency) to allow for deviations from the respective frequency that may result from variations in manufacturing, component or fabrication processes used for devices that communicate with the device 200. The bandwidth may be further expanded using different techniques. For example, the bandwidth may be expanded by adding a parasitic element and stagger tuning the parasitic element to the antenna conductor 210. The communication lines 225 may be soldered at the transceiver 230 and terminate at the offset feed points 220. The dipole antenna 210 may connect to a feed line 225 via connectors 220. The offset feed points 220 may be soldered to the conductors of the dipole antenna 210. However, for ease of manufacturing and replacement, the offset feed points 220 include signal conducting pins that may be, for example, spring-loaded touch connectors, known as "Pogo pins", or flexible connectors (e.g., spring clips), or any type of connector between the communication lines 225 and the conductors of the dipole antenna 210 that allows there to be acceptable performance of the device 200. For example, the offset feed points 220 may connect to the communication lines 225 directly or by some other method such as jumpers, plugs, cables, conductive solder bumps, or the like. The communication lines 225 may be formed from wires, etched metal waveguides, metallic strips, or the any other suitable conductor. The gamma matching of the dipole antenna 210 with the signal chain impedance may also take into account an impedance of the signal conducting pins and an impedance of the transceiver 230.

The housing 250 may be configured as a replacement for a standard switch plate, such as those used in residential or office lighting installations. The housing 250 may be formed from a material, such as plastic, and cover the dipole antenna 210 from view of users within the residence or office. The housing 250 may also have other configurations to allow it to be used in other appliances, such as a microwave or a television as described with respect to FIG. 4. The conductors of the dipole antenna 210 may be conformed to the shape of the housing 250. For example, the conductors may be folded around obstacles, such as mounting hardware or a corner of the housing 250 and still provides suitable performance for the application. When the housing 250 is implemented as a switch plate and mounted on a wall, the antenna 210 and the PCB 230 may be built into the switch plate. The switch plate housing 250 may protrude slightly more from the wall than a standard wall-mounted switch plate. The dipole antenna 210 may either be printed (using plating techniques or conductive ink) on the back of the housing 250 or made as a stamped conductor (from wire similar in dimension to a paper clip) that is put into the housing 250.

The housing 250 may be made from a metal, plastic or some other moldable material. Stamped metal or conductive ink may be used to form the dipole antenna configurations. The housing 250 may be etched, using a laser for example, and plated forming a conductive path having substantially similar properties as the dipole antenna. The housing 250 may be covered with an aesthetically pleasing cover when made from a conductive material. The different housing configurations may affect the antenna radiation patterns as well as alter the antenna bandwidth. In an implementation, the system 200 may provide a balanced antenna implemented into a light switch that mitigates the ground plane interference of the PCB 240.

Alternatively, the housing 250 may be made from a conductive material, such as metal. By etching, stamping, or cutting of the housing 250, an antenna 210 configuration having the appropriate gamma matching properties may be produced. For example, a complementary slot antenna configuration may be produced in which an all metal switch plate with a hole cut into it produces a radiation pattern, effective bandwidth, and matched impedance similar to that of a dipole antenna. In a slot antenna configuration, the connectors 220 may have to be configured differently than in a dipole antenna configuration. For example, the connectors 220 may have to perpendicular to the housing.

Figure 2:
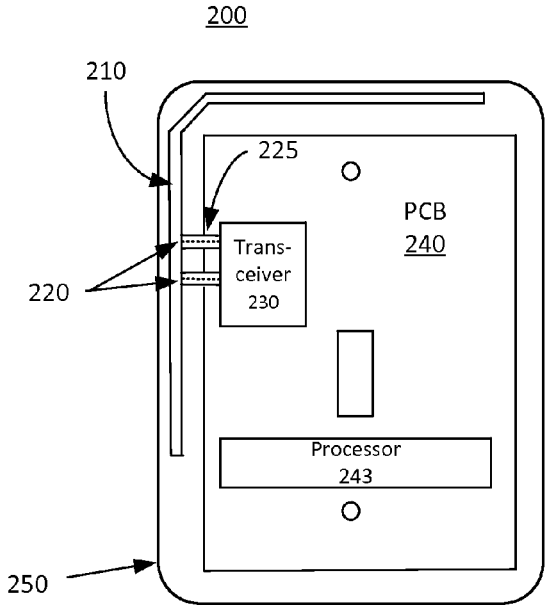
FIG. 2 shows an exemplary system incorporating a dipole antenna according to an implementation of the disclosed subject matter.

Also shown in FIG. 2 is a processor 243 that may be hosted on the PCB 240 or otherwise incorporated into devices as disclosed herein. The processor 243 may be programmed to respond to signals from the transceiver 230, and to issue commands to other devices (not shown) via the transceiver 230. The processor 243 may also cause data to be stored, or retrieve data from a data storage (not shown).

Figure 3:
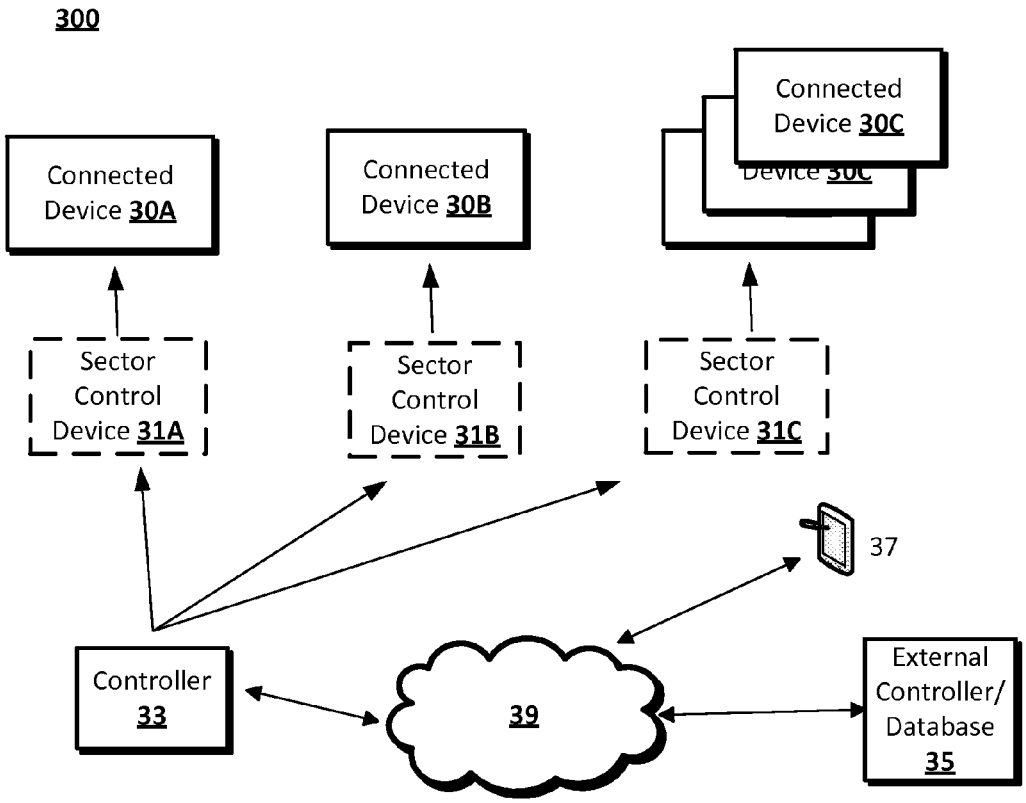
FIG. 3 shows a network configuration according to an implementation of the disclosed subject matter.

FIG. 3 shows an example network arrangement according to an implementation of the disclosed subject matter. One or more connected device 30A-C, such as an intelligent light bulb, an intelligent light switch, a receptacle, a television, refrigerator or the like may connect to other device, such as a controller 33. The connected device 30A-C may include a dipole antenna, a PCB, a processor and a transceiver as explained above with respect to FIG. 2. A connected device 30A-C may optionally communicate with one or more sector control devices 31A-C. In addition, connected devices 30C may be connected to other connected devices and may respond to commands not only individually, but as a group. For example, if connected devices 30C are light bulbs, lighting fixtures, or the like, the controller 33 may transmit a command turning on all of the connected devices 30C, or a command to turn the connected devices 30C on with varying levels of intensity (e.g., dimly lighting a room, or gradually lighting a room from the entrance to a seating area).

The sector control devices 31A-C may be optional intermediate devices that communicate with the connected devices 30A-C and/or a controller device 33. For example, the sector control device 31A-C may be a light switch device, a receptacle, a power supply device or the like. The sector control device 31A-C may include a dipole antenna, a processor and a transceiver. The sector control device 31A-C may communicate with each connected device 30A-C, and may monitor the status of each of the connected devices 30A-C. The sector control device 31A-C may, in response to instructions from the controller 33, provide control signals to the connected devices 30A-C. The sector controls devices 31A-C may send status information related to the connected devices 30A-C to the controller 33. The controller 33 may include a dipole antenna, a processor and a transceiver. The controller 33 may connect to one or more networks 39. The network 39 may be a local network (e.g., Wi-Fi), wide-area network, the Internet, or any other suitable communication network or networks, and may be implemented on any suitable computerized platform including wired and/or wireless networks. The network 39 may connect to remote platforms 37 and external controllers, databases, or the like 35. The remote platforms 37 may be access the controller 33, the connected devices 30A-C, and/or sector control devices 31A-C, if present. The remote platforms 37 may be a smartphone, a tablet device, a laptop, desktop or other computing device capable of accessing the network 39. For example, remote platform 37 may be a device with cellular network connectivity, and may access a cellular network that connects to the controller 33, sector control devices 31A-C, and/or connected devices 30A-C. Of course, other techniques and networking hardware may be used to provide connectivity between the controller 33 and the exemplary device 31A-C or 30A-C. The example sector control devices 31A-C or connected devices 30A-C may be either an endpoint or an intermediary device in the network 39. Connected device 30C shows multiple connected devices that may also communicate to one another. For example, connected devices 30C may be connected in a daisy chain network configuration. The connected devices 30A-C, sector control device 31A-C, and controller 33 may transmit or receive radio frequency signals in a range of frequencies according to the tuning of a dipole antenna (not shown).

Figure 4:
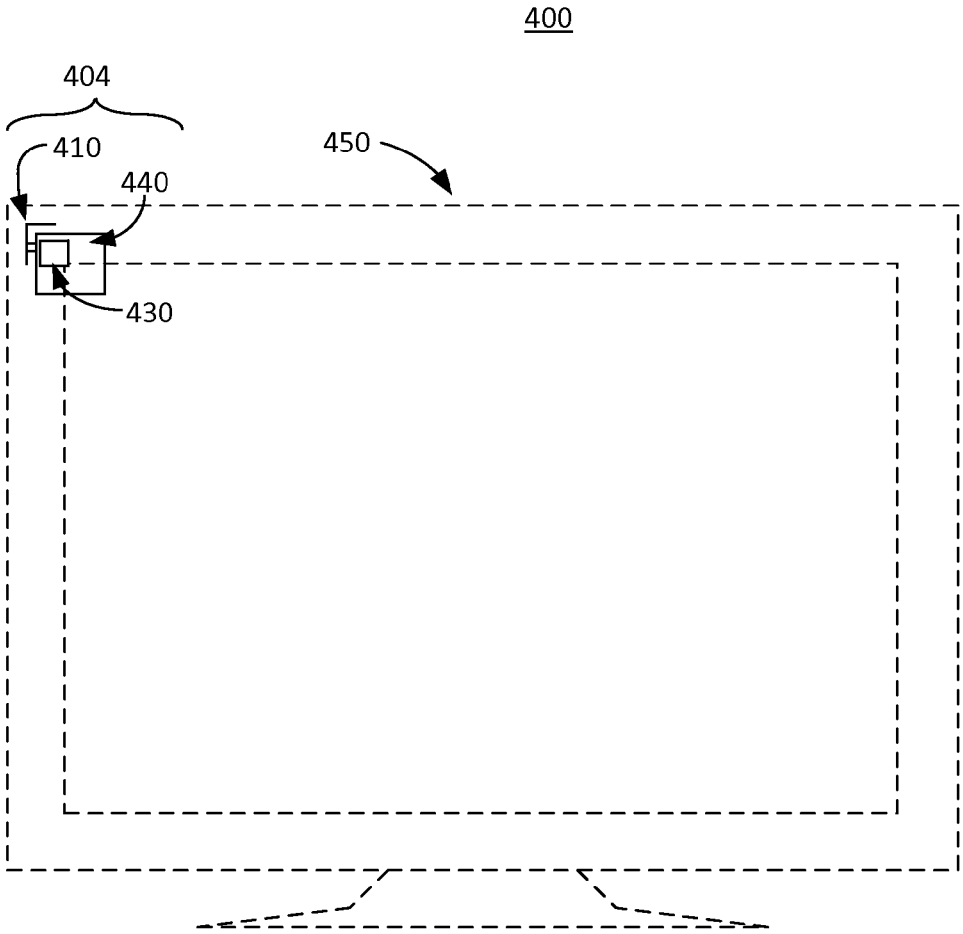
FIG. 4 illustrates an exemplary system incorporating a dipole antenna according to an implementation of the disclosed subject matter.

FIG. 4 illustrates an alternative housing of a dipole antenna according to an implementation of the disclosed subject matter. The system 400 may be a television, but may be another type of appliance, such as a printer, a microwave, lighting controller, light bulbs, a refrigerator, stereo audio receiver or the like. The housing 450 may be the outer housing of a television or computer monitor. The control device 405 may include components, such as a dipole antenna 410, a transceiver 430 and a printed circuit board (PCB) 440. The components may allow the system 400 to communicate with other surrounding devices, such as a lighting controller to dim the lights when the system 400 is in use, for example. The transceiver 430 may transmit or receive radio frequency signals in a range of frequencies according to the tuning of the dipole antenna 410.

Figure 5:
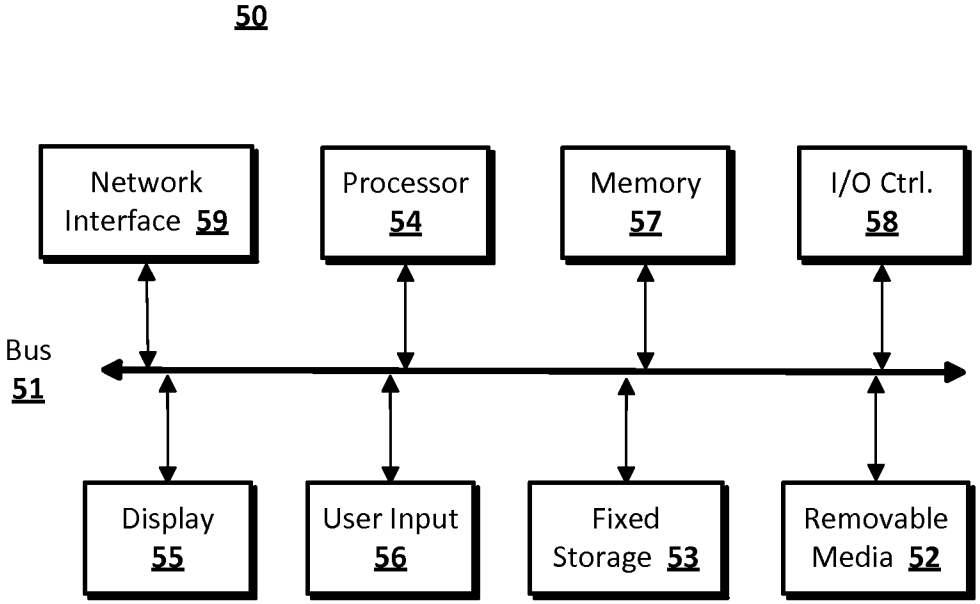
FIG. 5 shows a computer incorporating a dipole antenna according to an implementation of the disclosed subject matter.

Implementations of the presently disclosed subject matter may be implemented in and used with a variety of component and network architectures. FIG. 5 is an example computer 50 suitable for implementing implementations of the presently disclosed subject matter. For example, the computer 50 may be an implementation, for example, on the PCB 240 of FIG. 2 in a controller or connected device shown in FIG. 3. The computer 50 includes a bus 51 which interconnects components of the computer 50, such as, for example, a central processor 54, a memory 57 (typically RAM, but which may also include ROM, flash RAM, or the like), an input/output controller 58, a user display 52, such as a display screen via a display adapter, a user input interface 56, which may include one or more controllers and associated user input devices such as a keyboard, mouse, and the like, and may be closely coupled to the I/O controller 58, fixed storage 53, such as a hard drive, flash storage, Fibre Channel network, SAN device, SCSI device, and the like, and a removable media component 55 operative to control and receive an optical disk, flash drive, and the like.

The bus 51 allows data communication between the central processor 54 and the memory 57, which may include read-only memory (ROM) or flash memory (neither shown), and random access memory (RAM) (not shown), as previously noted. The RAM is generally the main memory into which the operating system and application programs are loaded. The ROM or flash memory can contain, among other code, the Basic Input-Output system (BIOS) which controls basic hardware operation such as the interaction with peripheral components. Computer applications resident with the computer 50 are generally stored on and accessed via a computer readable medium, such as a hard disk drive (e.g., fixed storage 53), an optical drive, floppy disk, or other storage medium 55.

The fixed storage 53 may be integral with the computer 50 or may be separate and accessed through other interfaces. A network interface 59 may provide a direct connection to a controller device, a remote server via a telephone link, to the Internet via an internet service provider (ISP), or a direct connection to a remote server via a direct network link to the Internet via a POP (point of presence), a transceiver at the frequencies to which a dipole antenna may be tuned, or other technique. The network interface 59 may provide such connection using wireless techniques, including Wi-Fi (802.11xx), Zigbee, ISM frequencies, digital cellular telephone connection, digital satellite data connection or the like. For example, the network interface 59 may allow the computer to communicate with other computers via one or more local, wide-area, or other networks, as shown in FIG. 5.

Many other devices or components (not shown) may be connected in a similar manner (e.g., document scanners, digital cameras and so on). Conversely, all of the components shown in FIG. 5 need not be present to practice the present disclosure. The components can be interconnected in different ways from that shown. The operation of a computer such as that shown in FIG. 5 is readily known in the art and is not discussed in detail in this application. Code to implement the present disclosure can be stored in computer-readable storage media such as one or more of the memory 57, fixed storage 53, removable media 55, or on a remote storage location.

The described implementations may be manufactured using various manufacturing methodologies and techniques. For example, a dipole antenna having conductors with offset signal feeds may be obtained. The dipole antenna may be pre-fabricated or fabricated in a different location or on a different assembly line. The dipole antenna may be placed by fabricating machinery or other methods in a housing. The housing may be, for example, on the backside of a wall switch plate, a television or any appliance casing or similar housing that may be separately mounted in an appliance. Another manufacturing step may include positioning a printed circuit board with a transceiver adjacent to the dipole antenna. The printed circuit board may be communicatively coupled to the dipole antenna. Conductors may be placed to make contact between the signal feeds and a communication path to the transceiver. The manufacture of the device may result in an impedance of the dipole antenna to be gamma matched to impedance of the conductors, communication path, and the transceiver.

More generally, various implementations of the presently disclosed subject matter may include or be embodied in the form of computer-implemented processes and apparatuses for practicing those processes. Implementations also may be embodied in the form of a computer program product having computer program code containing instructions embodied in non-transitory and/or tangible media, such as floppy diskettes, CD-ROMs, hard drives, USB (universal serial bus) drives, or any other machine readable storage medium, wherein, when the computer program code is loaded into and executed by a computer, the computer becomes an apparatus for practicing implementations of the disclosed subject matter. Implementations also may be embodied in the form of computer program code, for example, whether stored in a storage medium, loaded into and/or executed by a computer, or transmitted over some transmission medium, such as over electrical wiring or cabling, through fiber optics, or via electromagnetic radiation, wherein when the computer program code is loaded into and executed by a computer, the computer becomes an apparatus for practicing implementations of the disclosed subject matter. When implemented on a general-purpose microprocessor, the computer program code segments configure the microprocessor to create specific logic circuits. In some configurations, a set of computer-readable instructions stored on a computer-readable storage medium may be implemented by a general-purpose processor, which may transform the general-purpose processor or a device containing the general-purpose processor into a special-purpose device configured to implement or carry out the instructions. Implementations may be implemented using hardware that may include a processor, such as a general purpose microprocessor and/or an Application Specific Integrated Circuit (ASIC) that embodies all or part of the techniques according to implementations of the disclosed subject matter in hardware and/or firmware. The processor may be coupled to memory, such as RAM, ROM, flash memory, a hard disk or any other device capable of storing electronic information. The memory may store instructions adapted to be executed by the processor to perform the techniques according to implementations of the disclosed subject matter.

The physics of modern electrical devices and the methods of their production are not absolutes, but rather statistical efforts to produce a desired device and/or result. Accordingly, no limitation in the description of the present disclosure or its claims can or should be read as absolute. The limitations of the claims are intended to define the boundaries of the present disclosure, up to and including those limitations. To further highlight this, the term "substantially" may occasionally be used herein in association with a claim limitation (although consideration for variations and imperfections is not restricted to only those limitations used with that term). While as difficult to precisely define as the limitations of the present disclosure themselves, we intend that this term be interpreted as "to a large extent", "as nearly as practicable", "within technical limitations", and the like.

The foregoing description and following appendices, for purpose of explanation, have been described with reference to specific implementations. However, the illustrative discussions above are not intended to be exhaustive or to limit implementations of the disclosed subject matter to the precise forms disclosed. Many modifications and variations are possible in view of the above teachings. The implementations were chosen and described in order to explain the principles of implementations of the disclosed subject matter and their practical applications, to thereby enable others skilled in the art to utilize those implementations as well as various implementations with various modifications as may be suited to the particular use contemplated.

The invention claimed is:

1. A device, comprising:

a dipole antenna having a first conductor and a second conductor with respective signal connections offset from one another for transmitting and receiving signals, wherein the signal connection of the second conductor is offset from the signal connection of the first conductor by a portion of a length of the second conductor and a width of a slot between the first conductor and the second conductor, and the dipole antenna is enclosed in a housing;

signal conductors communicatively connected to the offset signal connections; and a transceiver connected to the signal conductors through a balanced communication signal path, wherein an impedance of the dipole antenna is substantially gamma matched to a signal chain impedance according to an amount of offset of the signal connections, wherein the signal chain impedance includes an impedance of the signal conductors and an impedance of the transceiver.

2. The device of claim 1, wherein the housing is a switch plate housing.

3. The device of claim 1, wherein the housing is within a household appliance.

4. The device of claim 1, wherein the first and second conductors are offset from one another to produce an impedance of the dipole antenna that substantially matches the impedance of the signal conductors and the transceiver.

5. The device of claim 1 wherein the balanced communication signal path provides substantially equal current to both feed points of the antenna conductors.

6. The device of claim 1, further comprising:

a printed circuit board communicatively connected to the transceiver.

7. The device of claim 6, wherein the printed circuit board comprises a balanced signal path communication line.

8. The device of claim 7, wherein the balanced signal path communication line comprises a pair of signal lines that have substantially equal impedance, wherein the pair of signal lines are disposed to connect to the signal conductors.

9. The device of claim 7, wherein the balanced signal path communication line provides substantially equal current to both feed points of the antenna conductors.

10. A system, comprising:

a housing;

a dipole antenna having first and second signal feeds for first and second conductor regions, respectively, wherein said first and second conductor regions are shaped to conform to the housing, wherein a signal connection of the second conductor is offset from a signal connection of the first conductor by a portion of a length of the second conductor and a width of a slot between the first conductor and the second conductor;

a transceiver having first and second signal connections; and first and second connectors between said first and second signal feeds, respectively, of the dipole antenna and the transceiver, wherein communication paths between the first connector and the transceiver and the second connector and the transceiver are balanced.

11. The system of claim 10, wherein one of the signal feeds to a respective conductor region is offset from the other conductor region to produce an impedance of the dipole antenna that substantially matches the impedance of the connectors and the transceiver.

12. The system of claim 10, wherein the connectors are spring loaded connectors.

13. The system of claim 10, wherein the connectors are spring clip connectors.

14. The system of claim 10, wherein the housing is an electrical switch plate.

15. The system of claim 14, wherein the electrical switch plate is a conductive material forming the dipole antenna.

16. The system of claim 10, wherein the housing is contained within a television.

17. The system of claim 10, wherein the housing is contained within a product selected from the group consisting of an intelligent light bulb, an intelligent light switch, a receptacle, a television, an audio system, a refrigerator, and a controller device.

18. The system of claim 10, wherein the two conductors are coupled to one another by a conductive member.

19. A device, comprising:

a processor configured to output and receive control signals via a wireless communication path; and a dipole antenna disposed in a wall-mounted switch plate, wherein the dipole antenna comprises a first conductor with a signal connection and a second conductor with a signal connection, wherein the signal connection of the second conductor is offset from the signal connection of the first conductor by a portion of a length of the second conductor and a width of a slot between the first conductor and the second conductor.

20. The device of claim 19, further comprising a transceiver for transmitting and receiving the control signals over the wireless communication path.

21. A system, comprising:

a first device configured with a dipole antenna having offset signal conductors in a wall switch housing, a transceiver and a processor, wherein the dipole antenna of the first device comprises a first conductor with a signal connection and a second conductor with a signal connection, wherein the signal connection of the second conductor is offset from the signal connection of the first conductor by a length of the second conductor and a width of a slot between the first conductor and the second conductor; and a second device configured with a dipole antenna having offset signal conductors, a processor and a transceiver communicatively coupled to the transceiver of the first device, wherein the dipole antenna of the second device comprises a first conductor with a signal connection and a second conductor with a signal connection, wherein the signal connection of the second conductor is offset from the signal connection of the first conductor by a portion of a length of the second conductor and a width of a slot between the first conductor and the second conductor, wherein the second device and the first device are disposed for communication with one another.

22. The system of claim 21, wherein the processor of the second device is configured to respond to signals received from the first device.

23. The system of claim 21, wherein the first device is further configured with an actuating lever, wherein the actuation of the lever causes a control signal to be sent to the second device.

24. The system of claim 21, further comprising:

a third device configured with a dipole antenna having offset signal conductors, a processor and a transceiver communicatively coupled to the transceiver of the first device.

25. The system of claim 21, further comprising:

a third device configured with a dipole antenna having offset signal conductors, a processor and a transceiver communicatively coupled to the transceiver of the second device.

26. The system of claim 21, further comprising:

a third device configured with a dipole antenna having offset signal conductors, a processor and a transceiver communicatively coupled to the transceiver of both the first device and the second device.

* * * * *